33-242 SR
10/5/76 XR 3,983,634

United States Patent [19]

Erickson

[11] 3,983,634

[45] Oct. 5, 1976

[54] SUN SHADES FOR GUN SIGHTS

[76] Inventor: Martin O. Erickson, Rte. 3, Box 292, Bozeman, Mont. 59715

[22] Filed: Aug. 4, 1975

[21] Appl. No.: 601,489

[52] U.S. Cl. ..... 33/244; 33/242
[51] Int. Cl.[2] ..... F41G 1/14; F41G 11/00
[58] Field of Search ..... 33/242, 243, 244, 258

[56] References Cited

UNITED STATES PATENTS

| | | | |
|---|---|---|---|
| 912,050 | 2/1909 | Wanee | 33/243 |
| 986,376 | 3/1911 | French | 33/244 |
| 1,711,578 | 5/1929 | Redfield | 33/258 |
| 2,115,184 | 4/1938 | Vaver | 33/258 |
| 2,173,701 | 9/1939 | Swebilius | 33/258 |
| 2,204,483 | 6/1940 | Forsling | 33/244 |

*Primary Examiner*—Richard E. Aegerter
*Assistant Examiner*—Richard R. Stearns
*Attorney, Agent, or Firm*—Warren F. B. Lindsley

[57] ABSTRACT

Sun shade tubes of variable length and diameter adaptable to the rear sight of most target rifles for keeping the sun or bright light from shining directly into the eyes of the shooter.

9 Claims, 5 Drawing Figures

SUN SHADES FOR GUN SIGHTS

BACKGROUND OF THE INVENTION

This invention relates to attachments for gun sights and more particularly to sun shades for mounting on such sights for facilitating the use of said sights.

DESCRIPTION OF THE PRIOR ART

The use of telescopic sights on weapons is well known and widely practiced. Certain problems are inherent in the use of these sights, however, and these problems have tended to make many hunters and sportsman refrain from using them. The end of the sight and the user's eye are normally spaced from each other which permits light to enter the sighting end of the sight and make viewing through the sight difficult. Light entering the sighting end of the sight also causes side reflections along the length of the sight if the user does not have the sight in perfect focused alignment with his eye. Thus, it is desirable in many instances to improve on the use of the gun sight mounted on the gun rather than adding telescopic sights to it.

SUMMARY OF THE INVENTION

It is therefore the general object of this invention to provide an attachment for gun sights. More specifically, it is an object of this invention to provide an improved sun shade for a gun sight which will control side reflections within the gun sight.

Another object of this invention is to provide a gun shade for a gun sight which is mounted on the barrel of the gun downstream of the rear sight.

A further object of this invention is to provide an improved sun shade for the rear sights of rifles employing a polarized lens for varying the amount of light entering the aperture of the sight to reduce glare.

A still further object of this invention is to provide a sun shade for the sight of a gun employing polarized lenses which control the light entering a peep sight of the gun without disturbing the sight's setting.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENTS

Figure 1:
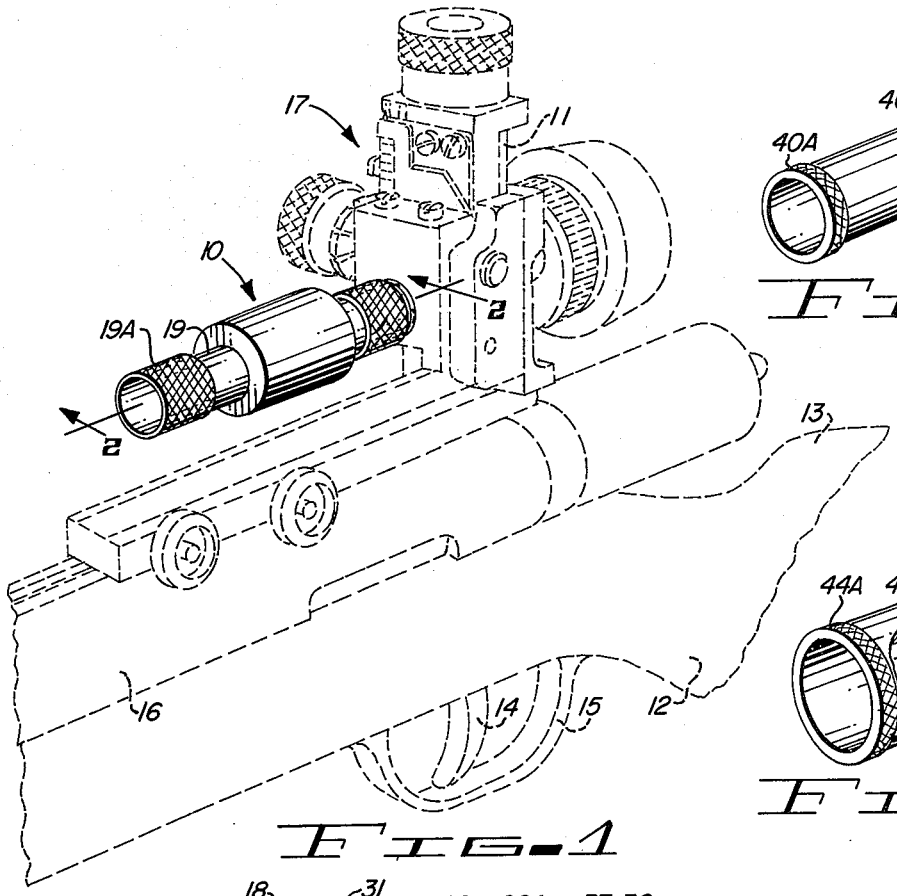
FIG. 1 discloses a partial perspective view of a rifle shown in dash lines with the novel gun shade threadedly secured to the rifle's rear sight.

Referring more particularly to the drawing by characters of reference, FIG. 1 discloses my improved sun shade 10 mounted on a rear peep sight 11 of a rifle 12. The rifle is partially shown in dash lines merely for purposes of illustration to show the relationship of the sun shade to the various parts of the rifle. It should be noted that the disclosed and claimed sun shade may be used on most rifles employing a rear gun sight into which the disclosed sun shade may be threadedly mounted into an aperture positioned forwardly of the sight.

As noted from FIG. 1 of the drawing, only a part of the gun is shown, and more particularly, only that part of the stock 13, trigger 14, trigger guard 15, barrel 16, and rear sight 17 necessary to illustrate one example of a mounting arrangement of the sun shade 10. The usual bead sight member (not shown) arranged at the forward end of barrel 16 of the rifle has been omitted for simplicity sake.

As frequently happens in shooting, light shining on the bead may interfere with proper sighting and many times, the bead forward sight is surrounded with a sun shade, but the most important point for shading a sight is adjacent the rear sight 11.

In the present invention, the sun problem has been cured by adding a sun shade to the forward end of the rear or peep sight 11 of the gun.

Figure 2:
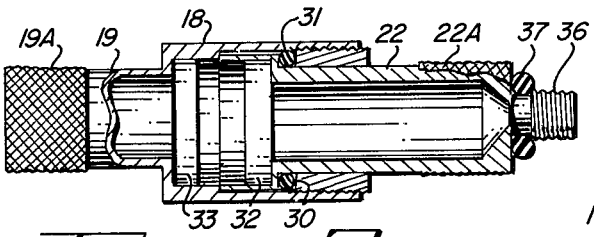
FIG. 2 is a cross sectional view of the sun shade shown in FIG. 1 taken along the line 2—2.
Figure 3:
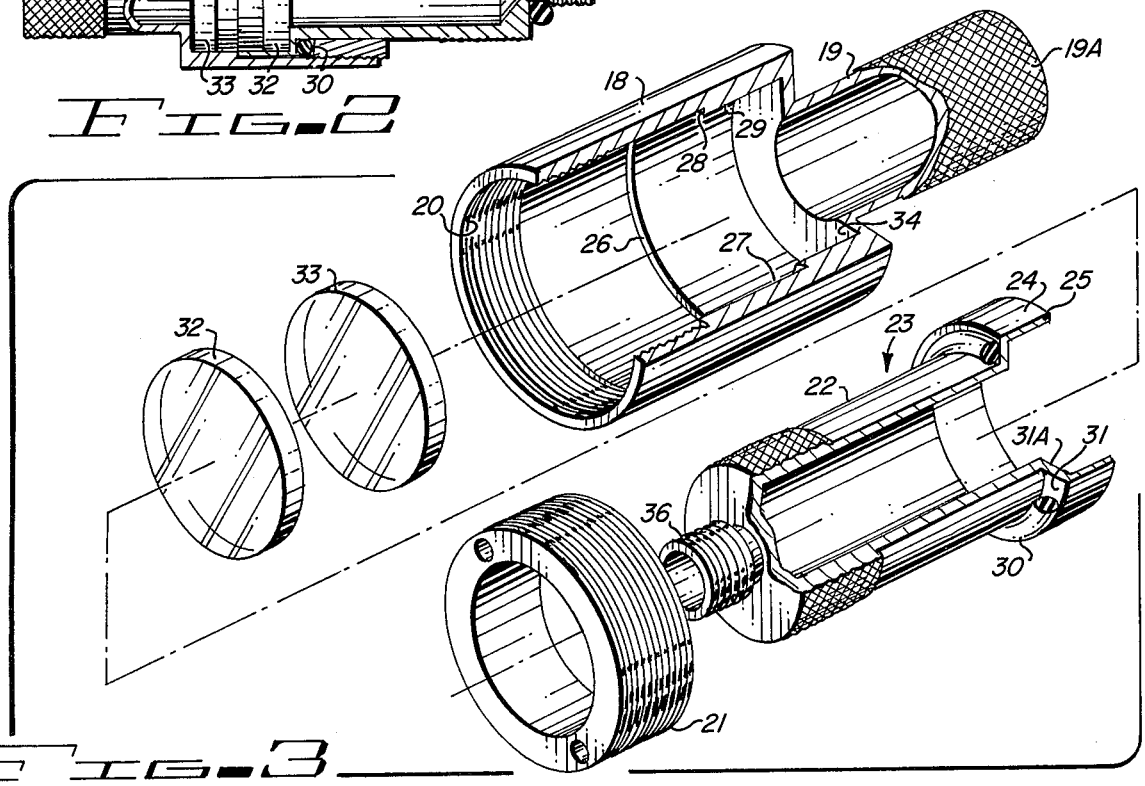
FIG. 3 is an exploded view of the sun shade shown in FIG. 1 with parts partially broken away to show more detail of the interior part of the sun shade.

Sun shade 10 is threadedly mounted on the forward end of any suitable rear sight of a rifle and, as illustrated in FIGS. 1–3, comprises a hollow cylindrical housing 18 having a smaller diameter, cylindrical hollow extension 19 axially aligned at one end thereof and provided with internal threads 20 at its other end for threadedly receiving a ring 21 internally thereof.

Ring 21 is adapted for slidably fitting over a cylindrical portion 22 of a tubular extension 23 of the sun shade. The tubular extension 23 is provided with an enlarged integrated axially aligned cylindrical portion 24 at one end, the outer end 25 of which is positioned by ring 21 against ledge 26 formed in the inner surface of the hollow cylindrical housing 18 at a point adjacent the inner end of threads 20. Ledge 26 is formed by a reduced portion 27 of the bore of housing 18. A further ledge 28 is formed near the hollow extension 19 by a further reduced portion 29 of the bore of housing 18, as shown more clearly in FIG. 3.

Thus, as the cylindrical portion 24 is inserted into cylindrical housing 18, its threaded end 25 is positoned against ledge 26 by the positioning of ring 21 over cylindrical portion 22, against an O-ring 30 which is fitted against a collar 31 formed by the interconnections of cylindrical portions 22 and 24.

As noted from FIGS. 2 and 3 of the drawing, a pair of polarized glass lenses 32 and 33 are fitted within housing 18. Lens 33 is positioned against a collar 34 formed between the end of housing 18 and the hollow extension 19 thereof which forms a light seal between these two parts of the sun shade. Lens 32 is positioned within the cylindrical portion 24 of the cylindrical portion 22 against a surface 31A of collar 31, i.e. the opposite surface of collar 31 from that on which the O-ring 30 is seated.

End 25 of the cylindrical portion 24 is limited in its inward movement within housing 18 by the abutment of end 25 against ledge 26 of housing 18. The outer surface of end 19A of extension 19 is knurled to aid in adjustably positioning lenses 32, 33 within housing 18 when the threaded end 36 of cylindrical portion 22 is threaded into a suitable opening in the forward end of the rear sight 11 of rifle 12. An O-ring 37 positioned around the outer surface of end 36 may be used in mounting the sun shade on a gun. As shown in FIGS.

1–3, a portion 22A of the outer surface of cylindrical portion 22 adjacent end 36 may be knurled to aid in threadly mounting the sun shade on the rear sight of the rifle.

It should be recognized that although a threaded end 36 of the cylindrical portion 22 is shown in the drawing, end 36 may be smooth and forms a suitable frictioned slip fit with the rear sight of a rifle, if so desired.

Figure 4:
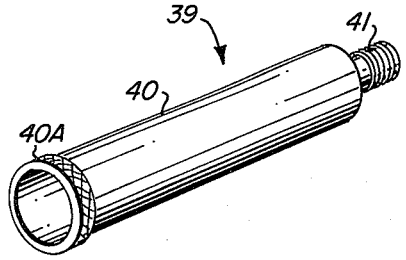
FIGS. 4 and 5 are illustrations of modifications of the sun shade shown in FIGS. 1–3.

FIG. 4 illustrates a modification of the sun shade shown in FIGS. 1–3 wherein sun shade 39 comprises a hollow cylindrical member 40 having a knurled surface 40A at one end and a reduced threaded member 41 at its other end. The threaded end is arranged for mounting in a suitable threaded opening in the rear sight of a gun such as a rifle.

This sight is a simple sun shade which does not involve any lens of adjustment means as embodied in the structure shown in FIGS. 1–3.

Figure 5:
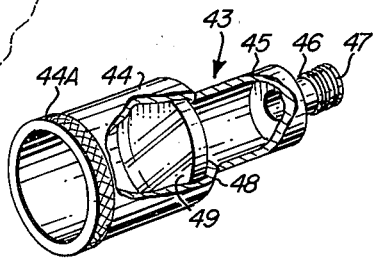

FIG. 5 illustrates a further modification of the sun shades shown in FIGS. 1–4 wherein sun shade 43 comprises a cylindrical housing 44 necked down at one end to provide an extension 45 which is further necked down at its end 46 to provide a threaded end 47 for mounting in a suitable threaded opening in the rear sight of a rifle.

Suitably mounted within the collar 48 formed between the integrated cylindrical housing 44 and its extension 45 is a polarized lens 49. Lens 49 may be held in position by means such as glue positioned around its periphery. The outer surface of the free end of cylindrical housing 44 is knurled at 44A to aid in threadedly mounting the sun shade on the rear sight of a rifle.

It should be noted that the sun shades disclosed may be formed of any suitable metal or plastic material and can be installed, removed or adjusted at any time without disturbing the adjustment of the rear sight of the rifle.

Although but a few embodiments of the invention have been shown and described, it will be obvious to those skilled in the art that various changes and modifications may be made therein without departing from the spirit of the invention and the scope of the appended claims.

What is claimed is:

1. A sun shade for mounting on the forward end of the rear sight of a gun comprising:
   a first hollow elongated cylindrical member of a given diameter,
   a second hollow cylindrical member of a smaller diameter than said first member having a first end threadedly mounted within one end of said first member in axial alignment therewith and including means at the second end thereof for mating along a portion of its periphery with an aperture in the rear sight of a gun,
   the other end of said first member having a knurled portion along a part of its outside periphery for grasping in mounting the sun shade on the rear sight of a gun,
   a lens; and
   means for mounting said lens between said first and second members.

2. The sun shade set forth in claim 1 in further combination with:
   a ledge formed on the first member at the interconnection of said first and second members, and
   means for holding said lens against said ledge.

3. The sun shade set forth in claim 1 wherein:
   said lens comprises a polarized glass lens.

4. The sun shade set forth in claim 3 in further combination with:
   a second lens mounted within said first member and spaced from said first lens.

5. A sun shade for mounting on the forward end of the rear sight of a gun comprising:
   a first hollow elongated cylindrical member of a given diameter,
   a second hollow cylindrical member of a smaller diameter than said first member coaxially positionable within one end of said first member,
   said second member having a collar at the end positioned within said first member,
   a ring slidably mounted over said second member for abutting said collar on said second member,
   said ring being threaded along at least a part of its outside periphery for engaging mating threads arranged within the bore of said one end of said first member, and
   a first lens mounted within said first member,
   said ring holding said first lens relative to said first member.

6. The sun shade set forth in claim 5 in further combination with:
   a second lens mounted within said first member and spaced from said first lens.

7. The sun shade set forth in claim 6 wherein:
   said first and second lenses are polarized glass lenses.

8. The sun shade set forth in claim 6 in further combination with:
   a first ledge formed within said first member for seating said second lens, and
   a second ledge formed within said first member for engaging said second member when inserted in said first member and forming a stop for the insertion of the second member in said first member.

9. The sun shade set forth in claim 8 wherein:
   the diameter of said first ledge is smaller than the diameter of said second ledge.

* * * * *